US006670002B1

(12) United States Patent
Sekiguchi et al.

(10) Patent No.: US 6,670,002 B1
(45) Date of Patent: Dec. 30, 2003

(54) INK JET RECORDING SHEET AND METHOD FOR PRODUCING IT

(75) Inventors: Hideki Sekiguchi, Tokyo (JP); Tetsuya Uto, Tokyo (JP); Jun Urasaki, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/317,862

(22) Filed: May 25, 1999

(30) Foreign Application Priority Data

May 26, 1998 (JP) ..... 10-143906
May 11, 1999 (JP) ..... 11-130396

(51) Int. Cl.[7] ..... B41M 5/00
(52) U.S. Cl. ..... 428/32.34; 427/152
(58) Field of Search ..... 428/195, 211, 428/220, 342, 331, 332, 32.34; 427/152

(56) References Cited

U.S. PATENT DOCUMENTS

| | | | | | |
|---|---|---|---|---|---|
| 4,609,479 | A | | 9/1986 | Smeltz | |
| 5,141,797 | A | | 8/1992 | Wheeler | |
| 5,457,081 | A | * | 10/1995 | Takiguchi et al. | 503/227 |
| 5,494,759 | A | * | 2/1996 | Williams et al. | 428/514 |
| 5,508,108 | A | * | 4/1996 | Tokiyoski et al. | 428/341 |
| 5,569,529 | A | * | 10/1996 | Becker et al. | 428/331 |
| 5,637,196 | A | * | 6/1997 | Ogawa et al. | 162/135 |
| 5,648,164 | A | * | 7/1997 | Sakaki et al. | 428/341 |
| 5,707,722 | A | * | 1/1998 | Iqbal et al. | 428/304.4 |
| 5,856,001 | A | * | 1/1999 | Okumura et al. | 428/331 |
| 5,965,252 | A | * | 10/1999 | Santo et al. | 428/329 |
| 5,989,378 | A | * | 11/1999 | Liu et al. | 156/241 |
| 6,200,416 | B1 | * | 3/2001 | Brotto et al. | 162/4 |

OTHER PUBLICATIONS

Technical Information Bulletin: Tyzor Organic Titanates, DuPont Performance Chemicals; retrieved from DuPont website (http://www.dupont.com. Site visited May 1, 2001).*

Technical Information Bulletin: Tyzor LA, DuPont Performance chemicals; retrieved from Dupont website (http://www.dupont.com. Site visited May 1, 2001).*

* cited by examiner

*Primary Examiner*—Bruce H. Hess
(74) *Attorney, Agent, or Firm*—Oblon, Spivak, McClelland, Maier & Neustadt, P.C.

(57) ABSTRACT

An ink jet recording sheet which comprises a support and an ink-receiving layer formed on at least one side of the support, said ink-receiving layer comprising a pigment, colloidal particles or a mixture thereof, and a binder resin, as the main components, wherein the ink-receiving layer contains at least one organic titanium compound of the following formula 1 or 2:

Formula 1

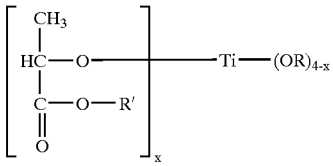

wherein R is hydrogen or $C_mH_{2m+1}$, provided that m is 3 or 4, R' is hydrogen, $NH_4^+$ or $C_nH_{2n+1}$, provided that n is an integer of from 1 to 3, and x is an integer of from 1 to 3, Formula 2

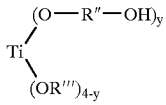

wherein R" is $C_pH_{2p}$, provided that p is an integer of from 5 to 8, R'" is $C_qH_{2q+1}$, provided that q is 3 or 4, and y is an integer of from 1 to 3.

17 Claims, No Drawings

INK JET RECORDING SHEET AND METHOD FOR PRODUCING IT

BACKGROUND OF THE INVENTION

1. Field of the Invention

The present invention relates to an ink jet recording sheet. More particularly, it relates to a high quality ink jet recording sheet which is free from yellowing.

2. Discussion of Background

The ink jet recording system is a system wherein fine droplets of ink are jetted by various operational principles such as a deflection, cavity, thermojetting, bubble jetting, thermal ink jetting, slit jetting or spark jetting system, and deposited on an ink jet recording sheet such as a paper sheet to form a record of images or letters. By virtue of its merits such as high speed, low noise, easiness to produce multi-color images, applicability to a wide variety of recording patterns and unnecessity of development or fixation, it has found a wide range of applications in various recording apparatus for figures including Chinese characters and for color images.

Further, images formed by an ink jet recording system using multi-color inks each containing a coloring material of yellow, magenta, cyan or black contained in a solvent such as water or a hydrophilic solvent, are capable of providing a record which is comparable to multi-color printed images by a printing plate system. Still further, when only a small number of prints are required, the ink jet recording system is inexpensive as compared with the development of silver salt photography, and it is being widely used also in the full color image recording field.

The ink jet recording system has been applied to various uses, as a result of developments in technique in recent years. When the use is limited for the output as a hard copy, it can be roughly classified into (1) one for general use (home use and for hobby), (2) one for office use (office automation) and (3) one for business use (EA and factory automation). Particularly for business use, a high quality hard copy of at least 400 dpi (16 dots/mm) is required, and the ink jet recording system is increasingly used.

Particularly, a high quality hard copy obtainable by the ink jet recording system is important as a substitute for a silver salt photography. In addition to the color reproducibility and gradation of the images, the storage stability of the ink jet recording sheet is an important property required. Here, the storage stability of the ink jet recording sheet may be roughly classified into the storage stability of the printed image portion such as color deterioration, color change or bleeding, and the storage stability of white paper such as color deterioration or color change.

Here, particularly with regard to the storage stability of the image portion, it has been known that when a pigment having a high fastness, as proposed, for example, in JP-A-57-10660, JP-A-57-10661, JP-A-4-234467, JP-A-5-156189, JP-A-5-179183, JP-A-5-202324, JP-A-5-263029, JP-A-5-331397, JP-A-6-122846 or JP-A-6-136311, is used instead of a known aqueous dye, light resistance, ozone resistance and water resistance can be significantly improved.

Further, by using an oil-soluble dye such as a naphthol dye, an azo dye, a metal complex dye, an anthraquinone dye, an quinoimine dye, an indigo dye, a cyanine dye, a quinoline dye, a nitro dye, a nitroso dye, a benzoquinone dye, a carbonium dye, a naphthoquinone dye, a naphthalimide dye, a phthalocyanine dye or a pelinine dye, as proposed in JP-B-7-78187, JP-B-7-78188, JP-B-8-6057, JP-B-8-26259, JP-B-6-247034 or JP-B-6-306319, an ink jet recording sheet having a high image density, an excellent color-forming property, high water resistance and cockle resistance, can be obtained.

As described above, with regard to the storage stability of the printed image portion, it has been recognized to be important to conduct overall studies including improvement in the inks, in addition to the ink jet recording sheet, and the inks have been improved in fact.

On the other hand, with regard to the storage stability of white paper, prevention of yellowing has been mainly studied. The yellowing of white paper is due to light, ozone, $NO_X$, heat, humidity or the like, and it may sometimes be caused by a certain antioxidant. Particularly, it has been known that the yellowing of white paper by an antioxidant is caused when a high quality hard copy is put in a file for storage, or when an adhesive tape is put on the surface of the ink-receiving layer. It is important to solve the problem for the ink jet recording system to substitute for a silver salt photography, and various studies for improvement have been made. However, a satisfactory ink jet recording sheet has not been obtained yet.

The ink jet recording sheet is required to provide a high image density and a light and clear color tone, to rapidly absorb inks or to prevent bleeding of inks even when printed dots are overlapped, to prevent too much diffusion of printed dots in the lateral direction, to provide almost round printed dots having smooth edge with no diffusion, and to provide high whiteness. It is possible to achieve such objects by coating a synthetic amorphous silica or a salt thereof, or a mixture thereof, with a binder resin as the case requires, on the surface of a paper sheet, or by packing such a material in a paper sheet, as disclosed in JP-A-57-157786, or by incorporating a porous cationic hydrated aluminum oxide in a paper sheet, as disclosed in JP-A-60-232990, or by incorporating a cationic hydrated aluminum oxide as cationic colloidal particles or a synthetic amorphous silica having a large specific surface area by BET method, in a paper sheet, as disclosed in JP-A-60-204390 or JP-A-2-198889.

However, such ink jet recording sheets are Likely to undergo yellowing as mentioned above. In the case of using a synthetic amorphous silica merely having a large specific surface area, or in the case of using colloidal particles of a hydrated alumina having a pseudo boehmite structure, in order to obtain desired image density or color-forming property, white paper significantly turns yellow.

It is estimated that the yellowing of white paper of the ink jet recording sheet is brought about in such a manner that when said recording sheet is put in a file containing 2,6-di-tert-butyl-4-methylphenol (hereinafter referred to as BHT) for storage, BHT transfers from the file to the ink-receiving layer of the recording sheet. Accordingly, it is considered that when the ink jet recording sheet is contacted with an article containing a phenol antioxidant represented by BHT, the recording sheet undergoes yellowing, which is accelerated by secondary factors such as ozone, $NO_X$ and $SO_X$, in air, temperature and humidity.

The yellowing due to BHT is described, for example, in Polymer Degradation and Stability 50 (1995) 313–317, Textil Praxis International Oktober (1980) 1213–1215, Textil Praxis International Marz (1983) 261–264, Textile Chemist and Colorist April (1983) Vol. 15, No. 4, 52–56 and Text. Progr. 15 (1987) 16, and it has been studied in the filed of fiber and apparel as a problem. It is known that the yellowing due to BHT takes place in such a manner that BHT turns to a compound having a stilbene quinone structure through an oxidation reaction.

JP-A-1-222987 interestingly proposes a method to evaluate the catalyst activity of the porous ink-receiving layer in the ink jet recording sheet when a dye in the ink is decomposed by oxygen, by a spot test using [4,4'-methylene-bis-2,6-(di-tert-butylphenol)] (hereinafter referred to as $BHT_2$). The spot test by $BHT_2$ is on the basis such that when BHT is oxidized to form a stilbene quinone structure, it turns yellow. Correlation between results of the test and the color change in a room of the printed images of the ink jet recording material, has been found.

JP-A-1-222987 further proposes that a preferred mode of a coating layer, i.e. the ink-receiving layer, with little yellowing by the spot test by $BHT_2$, is one having a silicon-containing pigment containing a metal selected from the group consisting of Mg, Ca, Zn and Ba in an amount of at least 0.1 wt %, contained in a recording surface, i.e. the ink-receiving layer. And it describes a resulting side effect such that the image density tends to decrease. To overcome such a side effect, it proposes to use a cationic substance together. However, light resistance is then likely to deteriorate. Thus, it has been known that the problem of storage stability of the image on the ink jet recording sheet relates to a phenol antioxidant represented by BHT.

Further, the degree of yellowing of BHT transferred to the ink-receiving layer depends on the material and constitution of the ink jet recording sheet. As described in the above proposal, it is significantly influenced particularly by the pigment or colloidal particles constituting the ink-receiving layer.

Accordingly, the object of the present invention is to provide a high quality ink jet recording sheet which is free from yellowing of white paper even when a high quality hard copy obtained by ink jet recording is put in e.g. a file for storage, or when an adhesive tape is put on the ink-receiving layer.

SUMMARY OF THE INVENTION

The present inventors have conducted extensive studies on the above problems on the ink jet recording sheet, and as a result, they have estimated that yellowing of white paper generated when a high quality hard copy obtained by ink jet recording is put in e.g. a file for storage, or when an adhesive tape is put on the ink-receiving layer, is caused by a phenol antioxidant represented by BHT contained in the file or the adhesive tape.

Representative examples of such a phenol antioxidant include BHT (Sumilizer BHT manufactured by Sumitomo Chemical Company, Limited., Yoshinox BHT manufactured by Yoshitomi Fine Chemicals, Ltd., Antage BHT manufactured by Kawaguchi Chemical Industry Co., Ltd.), n-octadecyl-3-(3',5'-di-tert-butyl-4'-hydroxyphenyl) propionate (Irganox 1076 manufactured by Ciba-Geigy, ADEKASTABU AO-50 manufactured by ASAHI DENKA KOGYO K.K., Sumilizer BP-76 manufactured by Sumitomo Chemical Company, Limited., Tominox SS manufactured by Yoshitomi Fine Chemicals, Ltd.), and 4,4'-butylidene-bis(3-methyl-6-tert-butylphenol) (ADEKASTABU AO-40 manufactured by ASAHI DENKA KOGYO K.K., Sumilizer BBM-S manufactured by Sumitomo Chemical Company, Limited., Yoshinox B B manufactured by Yoshitomi Fine Chemicals, Ltd., Antage W300 manufactured by Kawaguchi Chemical Industry Co., Ltd., Noclizer NS30 manufactured by Ouchi Shinko Chemical Industrial Co., Ltd., Nonflex B B manufactured by Seiko Chemical Co., Ltd.).

The present inventors have conducted extensive studies on a method to prevent the yellowing of white paper due to the above phenol antioxidants, and as a result, they have found that it is highly effective to incorporate a specific organic titanium compound in the ink-receiving layer.

Namely, the ink jet recording sheet of the present invention is an ink jet recording sheet which comprises a support and an ink-receiving layer formed on at least one side of the support, said ink-receiving layer comprising a pigment, colloidal particles or a mixture thereof, and a binder resin, as the main components, wherein the ink-receiving layer contains at least one organic titanium compound of the following formula 1 or 2:

Formula 1

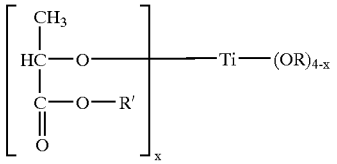

wherein R is hydrogen or $C_mH_{2m+1}$, provided that m is 3 or 4, R' is hydrogen, $NH_4^+$ or $C_nH_{2n+1}$, provided that n is an integer of from 1 to 3, and x is an integer of from 1 to 3, Formula 2

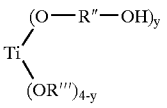

wherein R" is $C_pH_{2p}$, provided that p is an integer of from 5 to 8, R''' is $C_qH_{2q+1}$, provided that q is 3 or 4, and y is an integer of from 1 to 3.

When the ink-receiving layer has a surface pH of at most 6.0 as defined in TAPPI T529, more preferred result can be obtained.

Particularly, in the case where the support of the ink jet recording sheet is a paper sheet made from a slurry containing a natural pulp as the main component, by using an acidic paper as said paper, more preferred ink jet recording sheet can be obtained.

Further, in the case where the support of the ink jet recording sheet is a neutral paper made from a slurry having a natural pulp as the main component, by using a pseudo acidic paper having an aluminum sulfate liquid coated on said neutral paper, more preferred ink jet recording sheet can be obtained.

DETAILED DESCRIPTION OF THE PREFERRED EMBODIMENTS

Now, the ink jet recording sheet of the present invention will be explained in further detail.

The ink-receiving layer of the ink jet recording sheet of the present invention contains an organic titanium compound of the Formula 1 or 2, i.e. a titanium lactate compound or a titanium glycolate compound.

The titanium lactate compound may, for example, be dihydroxytitanium-bis(lactate), ammonium salt of dihydroxytitanium-bis(lactate), diammonium salt of dihydroxytitanium-bis(lactate), lactic acid titanate ammonium salt, di(isopropoxy)titanium-bis(methyl lactate), di(isopropoxy)titanium-bis(ethyl lactate), di(isopropoxy) titanium-bis(n-propyl lactate), di(isopropoxy)titanium-bis (isopropyl lactate), isopropoxy-isobutoxytitanium-bis (methyl lactate), isopropoxy-isobutoxytitanium-bis(ethyl lactate), isopropoxy-isobutoxytitanium-bis(n-propyl lactate), isopropoxy-isobutoxytitanium-bis(isopropyl lactate), di(isobutoxy)titanium-bis(methyl lactate), di(isobutoxy)titanium-bis(ethyl lactate), di(isobutoxy) titanium-bis(n-propyl lactate), di(isobutoxy)titanium-bis (isopropyl lactate), di-n-butoxytitanium-bis-methyl lactate or di(butoxy) titanium-bis(ethyl lactate).

The titanium glycolate compound may, for example, be titanium propoxyamylene glycolate, titanium propoxyhexylene glycolate, titanium propoxyheptylene glycolate, titanium propoxyoctylene glycolate, titanium triisopropoxymonopropylene glycolate, titanium triisopropoxymonooctylene glycolate, titanium-di-n-butoxy-bis-hexylene glycolate or titanium-di-n-butoxy-bis-octylene glycolate.

As the above organic titanium compound of the present invention, commercial items can be suitably used. Representative examples of the commercial items are mentioned below. However, the present invention is by no means restricted thereto. It may, for example, be ORGATIX TC300, ORGATIX TC310 or ORGATIX TC330, manufactured by Matsumoto Pharm. Ind. Co., Ltd., or TLA, TLA-70, TLA-A-50, TLA-AA-50 or TOG manufactured by Nippon Soda Co., Ltd.

Although the reason is not evident, particularly when a chelate compound of titanium lactate, i.e. dihydroxytitanium-bis(lactate), ammonium salt of dihydroxytitanium-bis(lactate) or diammonium salt of dihydroxytitanium-bis(lactate), is used, more excellent effect of prevention of yellowing of white paper of the ink jet recording sheet, can be obtained.

The content of such an organic titanium compound in the ink-receiving layer, is from 0.01 to 10 wt %, more preferably from 0.1 to 5 wt %, based on the pigment, colloidal particles or the mixture thereof, which constitutes the ink-receiving layer. If the content of the organic titanium compound is less than 0.01 wt %, prevention of yellowing of white paper is not sufficient. If the content exceeds 10 wt %, ink absorptivity may deteriorate, or color reproducibility of the image may sometimes be lowered.

As the method for incorporating such an organic titanium compound to the ink-receiving layer, the organic titanium compound is directly added to a coating fluid for the ink-receiving layer, comprising a pigment, colloidal particles or a mixture thereof, and a binder resin, as the main component, as mentioned hereinafter. However, by adding the organic titanium compound, the coating fluid may sometimes be significantly thickened, or uniform adding and mixing may sometimes be difficult. In such a case, the ink-receiving layer comprising a pigment, colloidal particles or a mixture thereof, and a binder resin, as the main components, is formed on the support, and then a solution containing the organic titanium compound is coated thereon to impregnate said solution to the ink-receiving layer, to obtain effects of the present invention.

The ink-receiving layer of the ink jet recording sheet of the present invention comprises a pigment, colloidal particles or a mixture thereof, and a binder resin, as the main components. As the pigment, the colloidal particles and the binder resin, conventional one may be used.

The pigment can be roughly classified into an inorganic pigment and an organic pigment. The inorganic pigment may, for example, be a synthetic amorphous silica, precipitated calcium carbonate light, heavy calcium carbonate, kaoline, talc, calcium sulfate, barium sulfate, titanium dioxide, zinc oxide, zinc sulfide, zinc carbonate, satin white, aluminum silicate, diatomaceous earth, calcium silicate, magnesium silicate, aluminum hydroxide, alumina, lithopone, zeolite, hydrated halloysite, magnesium carbonate or magnesium hydroxide. At least one inorganic pigment may be mixed in the ink-receiving layer of the ink jet recording sheet of the present invention.

On the other hand, as the organic pigment, white or colorless polymer beads can be particularly suitably used. It may, for example, be spherical or irregular, non-porous or porous beads made of at least one resin including an acrylic or methacrylic resin, a vinyl chloride resin, a vinyl acetate resin, a polyester resin, a styrene/acrylic resin, a styrene/butadiene resin, a polystyrene/acrylic resin, a polystyrene/isoprene resin, a methylmethacrylate/butylmethacrylate resin, a polycarbonate resin, a silicon resin, a urea resin, a melamine resin, an epoxy resin, a phenol resin and a diallylphthalate resin. It is also possible to mix at least one inorganic pigment and at least one organic pigment.

The ink jet recording sheet is required to provide a high image density and a light and clear color tone, to rapidly absorb inks, to prevent bleeding of inks even when printed dots are overlapped, to prevent too much diffusion of the printed dots in the lateral direction, to provide almost round printed dots having smooth edge with no diffusion, and to provide high whiteness. In order to satisfy such various conditions, the synthetic amorphous silica is particularly preferred among pigments as described above.

Here, the synthetic amorphous silica can be produced by employing an electrical arc process, a dry process or a wet process (sedimentation method or gel method). One having a particle size of from 0.1 to 30 $\mu$m by Coulter counter method, a specific surface area by BET method of at least 20 $m^2/g$, more preferably from 50 to 400 $m^2/g$, an oil absorption of at least 0.3 ml/g, more preferably at least 1.0 ml/g, and a brightness by Hunter of at least 90, is preferred. Specific examples of such a synthetic amorphous silica include:

(1) A synthetic silica or a salt thereof, or a mixture thereof (JP-A-55-51583, JP-A-57-157786).

(2) A synthetic silica having an average particle size of from 2.5 to 3.5 $\mu$m and a specific particle size distribution, and at least 20% of the total pores being pores of from 60 to 130 Å (JP-A-61-141584)

(3) A synthetic amorphous silica having a pH of 4 wt % suspension of from 9 to 12, an electroconductivity of from 400 to 1,000 micro mho/cm, and a chemical composition $Ni/SiO_2$ ratio of from 0.02 to 0.04 (JP-A-61-230979).

(4) An amorphous silica having a median diameter measured by colter counter method of from 2 to 15 $\mu$m, an oil absorption of 180 ml/100 g, a refractive index measured by solvent method of at least 1.450, and a moisture absorption of at least 35% under relative humidity of 90% at a temperature of 25° C. for 200 hours (JP-A-62-292476).

(5) Particles of covered silica having amorphous silica particles and a metal compound of Group II of the Periodic Table, said amorphous silica particles having a median diameter measured by Coulter counter method of from 2 to 15 $\mu$m, an oil absorption of 180 ml/100 g, a refractive index measured by solvent method of at least 1.450, and a moisture absorption of at least 35% under relative humidity of 90% at a temperature of 25° C. for 200 hours, and having the surface covered with the metal compound in an amount of from 0.5 to 20 wt % as oxide (JP-A-63-306074).

(6) Fine particles of silica having a specific surface area measured by BET method of at least 200 $m^2/g$, and an uniformity number n in Rosin-Rammler distribution of at least 1.10 (JP-B-3-26665).

(7) An alkali added amorphous silica having a specific surface area by BET of at least 200 $m^2/g$, an oil absorption of at least 180 ml/100 g, and an amount of acid at most 0.1 mmol/g to a range of acid strength (H0)+4.8 (JP-A-5-64953).

On the other hand, representative examples of the colloidal particles include an alumina hydrate (pseudo boehmite sol), a colloidal silica as disclosed in JP-A-60-219083, JP-A-61-19389, JP-A-61-188183, JP-A-63-178074 or JP-A-5-51470, a silica/alumina hybrid sol as disclosed in JP-B-4-19037 or JP-A-62-286787, smectite clay such as hectite or montmorillonite (JP-A-7-81210), a zirconia sol, a chromia sol, a yttria sol, a ceria sol, an iron oxide sol, a zircon sol and an antimony oxide sol.

Among the colloidal particles mentioned above, it is particularly preferred to use an alumina hydrate (pseudo boehmite sol). As in the case of using a synthetic amorphous silica as a pigment, high image density, a clear color tone and an excellent ink absorptivity can be obtained. Here, the pseudo boehmite sol is an alumina hydrate having a compositional formula of $Al_2O_3.nH_2O$ (n is from 1 to 1.5), and comprises colloidal particles in a form of cilia or flat plates. It can be produced by a synthetic method as described in USP 2,656,321, a synthetic method as described in JP-A-4-92813, hydrolysis of aluminium alkoxide, hydrolysis of sodium aluminate or a pH swing method. More specifically, it includes:

(1) An alumina sol in the form of a plate having the particle shape of aspect ratio 2 to 10, in a state where the sol diluted with water to a solid content of from 0.01 to 0.1 wt %, is dropped to the collodion membrane which is made hydrophilic followed by drying (J?-A-3-285814).

(2) An alumina sol in a columnar form having the particle shape of aspect ratio being at most 2, in a state where the sol diluted with water to a solid content of from 0.01 to 0.1 wt %, is dropped to the collodion membrane which is made hydrophilic followed by crying (JP-A-3-285815).

(3) An alumina sol produced by a production method of a boehmite organosol wherein a surface active agent is added to a boehmite hydrosol, and transferred to a non-polar organic solvent (JP-A-4-92813).

(4) An alumina sol produced by a production method wherein each of an aqueous alkali aluminate solution and an aqueous caustic alkali solution is introduced in a demineralization chamber and a concentration chamber, respectively, of a electrodialysis vessel alternately having alkali resistant anion exchange membranes and cation exchange membranes, to conduct electrodialysis to obtain an alumina sol (JP-A-7-802, JP-A-7-803).

(5) An alumina sol which is a sol having colloidal particles of alumina hydrate dispersed in an aqueous solvent, and which contains compounds having sulfonic acid groups in the molecule and having a pH of at most 4 in a state of 1 wt % aqueous solution (JP-A-8-33315).

(6) An alumina sol produced by a production method of an alumina sol which comprises hydrolysis of an aluminum alkoxide in an aqueous solvent to obtain a precipitate of alumina hydrate, and peptizing the precipitate to produce an alumina sol, wherein hydrolysis is conducted while alcohol in the solvent is removed (JP-A-6-64918).

(7) An alumina sol containing cations except hydrogen ions so that the total of ion equivalent concentration is within a range of from $2.0\times10^{-4}$ to $1.0\times10^{-1}$, and having a concentration of alumina of at least 10 wt %, and a viscosity measured by Brookfield viscometer of at most 5000 cps (JP-A-8-295509).

(8) An alumina sol having a boehmite structure, wherein the space between the faces of (020) of alumina hydrate is from not smaller than 0.167 to 0.620 nm, and the thickness of crystal in a direction perpendicular to (010) surface is within a range of from 6.0 to 10.0 nm (JP-A-9-99627).

(9) An alumina hydrate having an average pore radius of from 20 to 200 Å, and a half value width of the pore size distribution of from 20 to 150 Å (JP-A-7-232475).

(10) An alumina hydrate containing titanium dioxide in an amount of from 0.01 to 1.00 wt % (JP-A-7-232474).

(11) An alumina hydrate having at least two maximums in the pore radius distribution (JP-A-7-232473).

As mentioned above, in view of ink jet recording properties required for the ink jet recording sheet, a synthetic amorphous silica is particularly preferred as the pigment, and an alumina hydrate is preferred as the colloidal particles. However, as the results of extensive studies by the present inventors, yellowing of white paper of the ink jet recording sheet using such a synthetic amorphous silica or an alumina hydrate, is significant as compared with the case of using other pigments or colloidal particles. Accordingly, by the present invention, even with the ink-receiving layer using a synthetic amorphous silica or an alumina hydrate, yellowing of white paper can be prevented. Accordingly, an ink jet recording sheet which satisfies high ink jet recording properties and storage stability simultaneously, can be obtained.

To obtain an ink jet recording medium which suppresses generation of beading, and which has a high image density, a clear color tone, a high resolution and an excellent ink absorptivity, JP-A-9-76628 proposes a method wherein a dispersion is coated on the support followed by drying, or the dispersion is polymerized, said dispersion having an alumina hydrate which is subjected to surface treatment with a coupling agent, and a binder or a polymerizable compound. Here, as the coupling agent, various coupling agents of silane, titanate, aluminum or zirconium, may be mentioned. With regard to said proposal, the object can be achieved only by using an alumina hydrate having the surface preliminarily treated with various coupling agents. On the other hand, in the present invention, the yellowing of white paper can be prevented only when a specific organic titanium compound is used. The yellowing of white paper can hardly be improved by using coupling agents of silane, aluminum, zirconium or titanate except the organic titanium compounds of the present invention. Further, in the present invention, it is not necessary to preliminarily treat the surface of the pigment or the colloidal particles with an organic titanium compound, and as mentioned above, the object can be achieved only if the ink-receiving layer contains said compounds.

The ink-receiving layer of the ink jet recording sheet of the present invention comprises a pigment, a colloidal particles or a mixture thereof, and a binder resin for purposes of improving bonding between the ink-receiving layer and the support. The binder resin used suitably, may, for example, be polyvinyl alcohol, silanol denatured polyvinyl alcohol, polyvinyl acetate, oxidized starch, etherified starch, a cellulose derivative such as carboxymethyl cellulose or hydroxyethyl cellulose, casein, gelatin, acidic gelatin, soybean protein or silyl denatured polyvinyl alcohol; maleic anhydride resin, a copolymer latex of conjugated diene type such as a styrene-butadiene copolymer or a methylmethacrylate-butadiene copolymer; an acrylic polymer latex of acrylic type such as a polymer or a copolymer of acrylic ester or methacrylic ester, or a polymer or a copolymer of acrylic acid or methacrylic acid; a polymer latex of vinyl type such as an ethylene-vinyl acetate copolymer; a polymer latex of functional group modified type by a monomer containing functional groups such as a carboxyl group of such polymers; an aqueous adhesive of thermosetting synthetic resin such as an urea resin or a melamine resin; a synthetic resin type adhesive such as polymethyl methacrylate, a polyurethane resin, an unsaturated polyester resin, a vinyl chloride-vinyl acetate copolymer, a polyvinyl butyral or an alkyd resin. At least one of them may be used alone or as a mixture. In addition, known natural or synthetic resin binders may be used alone or as a mixture.

The amount of the binder resin is preferably from 0.1 to 100 parts by weight, more preferably from 2 to 50 parts by weight, based on 100 solid parts by weight of the pigment, the colloidal particles or the mixture thereof. If it is less than 0.1 part by weight, the strength of the coating layer of the ink-receiving layer tends to be inadequate, and if it exceeds 100 parts by weight, the ink absorptivity may be inadequate depending upon the type of the ink jet recording device, whereby the ink will bleed.

Other additives such as a cation primer for dye, a pigment dispersant, a thickener, a fluidity-improving agent, a defoaming agent, a foam-suppressing agent, a relief agent, a blowing agent, a penetrating agent, a coloring dye, a coloring pigment, a fluorescent brightener, an ultraviolet absorber, a preservative, an ash-preventing agent, a waterproofing agent, a wet-strength agent, a dry-strength agent and an antioxidant may be suitably incorporated in the ink-receiving layer of the ink jet recording sheet.

When the ink-receiving layer of the ink jet recording sheet of the present invention has a surface pH of at most 6.0 as defined in TAPPI T529, yellowing of white paper is more suppressed. This is attributable to the fact that the yellowing reaction of the phenol antioxidant represented by BHT is more suppressed at the region of acidic pH. Accordingly, it is also preferred to lower the pH of the ink-receiving layer by using an acidic substance such as hydrochloric acid, nitric acid, sulfonic acid or acetic acid.

The support for the ink jet recording sheet of the present invention includes:

(a) A base paper made from a chemical pulp such as LBKP or NBKP, a mechanical pulp such as GB, PGW, RMP, TMP, CTMP, CMP or CGP, or a natural pulp including a waste paper pulp such as DIP, and a known pigment, as the main components, made by using a slurry having a binder and at least one additive such as a sizing agent, a primer, a yield-improving agent, a cation agent or a strength agent mixed therewith, and produced by various apparatus such as a Fourdrinier paper machine, a cylinder paper machine or a twin wire paper machine;

(b) A coated paper made of a base paper having size press by e.g. starch or a polyvinyl alcohol or an anchor coat layer formed thereon, or an art paper, a coat paper or a cast coat paper having a coat layer provided on said base paper thus obtained;

(c) A base paper having smoothing treatment applied by using a calender apparatus such as a machine calender, a TG calender or a soft calender;

(d) A resin coat paper made from a base paper or a coated paper, having both sides or one side coated with a high density or low density polyethylene, polypropylene or polyester by e.g. melt extrusion;

(e) A translucent synthetic resin film having e.g. a pigment or a blowing agent incorporated in a synthetic resin film of e.g. polyethylene terephthalate, polypropylene, polyethylene, polyester, polycarbonate, norbornene, vinylon, polyvinyl alcohol or nylon, or such a material, to decrease transparency;

(f) A synthetic paper made by mixing a thermoplastic resin such as polyethylene, polypropylene, an ethylene/propylene copolymer, an ethylene/vinyl acetate copolymer, polystyrene or a polyacrylate ester, with an inorganic pigment such as calcium carbonate, talc, silica or calcined clay, followed by stretching and laminating;

(g) One made of such a support having the surface treated by e.g. a corona discharge treatment, a flame treatment, a plasma treatment or an anchor layer coating treatment, to improve adhesion.

Particularly, in the case where the support is a base paper made from a slurry containing a natural pulp as the main component, by using a pseudo acidic base paper having an aluminum sulfate liquid coated on an acidic base paper or a neutral base paper by means of a coating machine such as a tab size press, a film transfer coater, an air knife coater, a blade coater, a gate roll coater, a bar coater, a rod coater, a roll coater, a bill blade coater or a short dwell blade coater, an ink jet recording sheet whereby yellowing of white paper is more prevented, can be obtained. In the case of using so-called neutral paper having a natural pulp as the main component, and e.g. heavy calcium carbonate or precipitated calcium carbonate light mixed thereto as the filler, as the support for the ink jet recording sheet, the surface pH of the ink-receiving layer transfers to the alkali region as time passes. This is attributable to the fact that the filler is a solid alkali, and it influences the pH of the entire ink jet recording sheet including the ink-receiving layer. Accordingly, in the case of using a base paper as the support, it is one of preferred modes to use an acidic base paper or a pseudo acidic base paper.

Further, such a support may be subjected to a calender treatment such as a machine calender, a super calender, a gloss calender, a matte calender, a frictional calender or a brush calender. The basis weight of the support is usually from 50 to 300 g/m$^2$. The coating amount on the ink-receiving layer is not particularly limited. However, it is preferably from 1 to 50 g/m$^2$. If it is less than 1 g/m$^2$, an adequate printing density and ink absorptivity are less likely to be obtained, and if it exceeds 50 g/m$^2$, the curling property of the ink jet recording sheet tends to deteriorate.

In the present invention, the ink-receiving layer is formed on the support by using water or a hydrophilic organic solvent, or a mixed solvent thereof, or an organic solvent, by means of known various apparatus such as an air knife coater, a curtain coater, a die coaler, a lip coater, a blade coater, a gate roll coater, a bar coater, a rod coater, a roll coater, a bill blade coater, a short dwell blade coater, a size press or a film transfer coater.

Here, it is possible to coat a certain amount of the ink-receiving layer on the support in installments. As the method for coating the ink-receiving layer on the support in installments, after a layer gets dry, the next layer may be coated thereon, or a plurality of layers are simultaneously coated one on another as wet.

Further, the support having the ink-receiving layer coated thereon may be subjected to a smoothing treatment by means of a calender apparatus such as a machine calender, a TG calender, a super calender or a soft calender.

Particularly in the case of using a base paper as the support for the ink jet recording sheet of the present invention, a back coat layer may be coated on the other side of the support having the ink-receiving layer formed thereon, to impart curling property. As the pigment used here, a pigment in the form of a plate and hydrated halloysite are preferred. Curling straightening can also be conducted by jetting moisture by the humidifier such as fluidex, even in a case of not forming a back coat layer.

As the ink for the ink jet recording of the present invention, a known ink may be suitably used. In view of e.g. clarity of the image or the safety of the ink itself, aqueous inks employing the following coloring materials are commonly used. The coloring materials include direct dyes such as C.I.Direct Yellow 12, C.I.Direct Yellow 24, C.I.Direct Yellow 26, C.I.Direct Yellow 44, C.I.Direct Yellow 86, C.I.Direct Yellow 98, C.I.Direct Yellow 100, C.I.Direct Yellow 142, C.I.Direct red 1, C.I.Direct red 4, C.I.Direct red 17, C.I.Direct red 28, C.I.Direct red 83, C.I.Direct Orange 34, C.I.Direct Orange 39, C.I.Direct Orange 44, C.I.Direct Orange 46, C.I.Direct Orange 60, C.I.Direct Violet 47, C.I.Direct Violet 48, C.I.Direct Blue 6, C.I.Direct Blue 22, C.I.Direct Blue 25, C.I.Direct Blue 71, C.I.Direct Blue 86, C.I.Direct Blue 90, C.I.Direct Blue 106, C.I.Direct Blue 199, C.I.Direct Black 17, C.I.Direct Black 19, C.I.Direct Black 32, C.I.Direct Black 51, C.I.Direct Black 62, C.I.Direct Black 71, C.I.Direct Black 108, C.I.Direct Black 146 and C.I.Direct Black 154, acidic dyes such as C.I.Acid Yellow 11, C.I.Acid Yellow 17, C.I.Acid Yellow 23, C.I.Acid Yellow 25, C.I.Acid Yellow 29, C.I.Acid Yellow 42, C.I.Acid Yellow 49, C.I.Acid Yellow 61, C.I.Acid Yellow 71, C.I.Acid red 1, C.I.Acid red 6, C.I.Acid red 8, C.I.Acid red 32, C.I.Acid red 37, C.I.Acid red 51, C.I.Acid red 52, C.I.Acid red 80, C.I.Acid red 85, C.I.Acid 87, C.I.Acid red 92, C.I.Acid red 94, C.I.Acid red 115, C.I.Acid red 180, C.I.Acid red 256, C.I.Acid red 317, C.I.Acid red 315, C.I.Acid Orange 7, C.I.Acid Orange 19, C.I.Acid Violet 49, C.I.Acid Blue 9, C.I.Acid Blue 22, C.I.Acid Blue 40, C.I.Acid Blue 59, C.I.Acid Blue 93, C.I.Acid Blue 102, C.I.Acid Blue 104, C.I.Acid Blue 113, C.I.Acid Blue 117, C.I.Acid Blue 120, C.I.Acid Blue 167, C.I.Acid Blue 229, C.I.Acid Blue 234, C.I.Acid Blue 254, C.I.Acid Black 2, C.I.Acid Black 7, C.I.Acid Black 24, C.I.Acid Black 26, C.I.Acid Black 31, C.I.Acid Black 52, C.I.Acid Black 63, C.I.Acid Black 112 and C.I.Acid Black 118, basic dyes, reactive dyes and coloring matters for food.

On the other hand, as proposed in JP-A-57-10660, JP-A-57-10661, JP-A-4-234467, JP-A-5-156189, JP-A-5-179183, JP-A-5-202324, JP-A-5-263029, JP-A-5-331397, JP-A-6-122846 or JP-A-6-136311, the ink jet recording can be conducted by the ink containing a pigment as the coloring material. The pigment may, for example, be an azo pigment such as Para Nitraniline Red, Toluidine Red, Fire Red, Naphthylamine Bordeaux, Ortho Nitraniline Orange, Permanent Red G, Lake Fast Orange 3GL, Lithol Red, Lake Red C or Lake Red D, a slightly soluble azo pigment such as Watchung Red, Brilliant Carmine 6B, Bordeaux 10B, Mars Light, Yellow GL, Orange G or Naphthol ASITR, an insoluble azo pigment such as Permanent Red FR, Permanent Red FRLL, Permanent Red FGR, Permanent Red FBL, Permanent Red FRR, Carmine BS, Fast Yellow G, Fast Yellow 3G, Fast Yellow 5G, Fast Yellow 10G, Fast Yellow GR, Benzidine Yellow, Benzidine Yellow R, Benzidine Yellow GR, Benzidine Yellow G or Benzidine Yellow 5G, a phthalocyanine pigment such as copper (II) phthalocyanine, chlorinated copper phthalocyanine or metal-free phthalocyanine, a quinacridone pigment such as Sincasia Red Y, Sincasia Red B or Sincasia Red R, a dioxazine pigment such as triphendioxadine, carbazoledioxadine violet or violet, a building dye pigment such as Anthrapyrimidine Yellow, Frabanthron Yellow, anthrone Scarlet, Indanthrone Blue, Isobeoranthron violet, Thioindigo Bordeaux, Thioindigo maroon, pellinone orange, maroon or Scarlet, a condensed azo pigment, an isoindolinone pigment or an inorganic pigment such as carbon black, titanium oxide, zinc white, a lead chromate pigment or a cadmium pigment.

Further, as proposed in JP-B-7-78187, JP-B-7-78188, JP-B-8-6057, JP-B-8-26259, JP-B-6-247034 or JP-B-6-306319, the ink jet recording can also be conducted by employing an oil ink using an oil-soluble dye as the coloring material, such as a naphthol dye, an azo dye, a metal complex day, an anthraquinone dye, a quinoimine dye, an indigo dye, a cyanine dye, a quinoline dye, a nitro dye, a nitroso dye, a benzoquinone dye, a carbonium dye, a naphthoquinone dye, a naphthalimide dye, a phthalocyanine dye or a penilline dye.

Specifically, the oil-soluble dye may, for example, be C.I.Solvent Yellow 1, 2, 3, 4, 6, 7, 8, 10, 12, 13, 14, 16, 18, 19, 21, 25, 25: 1, 28, 29, 30, 32, 33, 34, 36, 37, 38, 40, 42, 43, 44, 47, 48, 55, 56, 58, 60, 62, 64, 65, 72, 73, 77, 79, 81, 82, 83, 83: 1, 85, 88, 89, 93, 94, 96, 98, 103, 104, 105, 107, 109, 112, 114, 116, 117, 122, 123, 124, 128, 129, 130, 131, 133, 134, 135, 138, 139, 140, 141, 143, 146, 147, 148, 149, 150, 151, 152, 153, 157, 158, 159, 160: 1, 161, 162, 163, 164, 165, 167, 168, 169, 170, 171 or 172; C.I.Solvent Red 1, 2, 3, 4, 7, 8, 13, 14, 17, 18, 19, 23, 24, 25, 26, 27, 29, 30, 33, 35, 37, 39, 41, 42, 43, 45, 46, 47, 48, 49, 49: 1, 52, 68, 69, 72, 73, 74, 80, 81, 82, 83, 83: 1, 84, 84: 1, 89, 90, 90: 1, 91, 92, 106, 109, 111, 117, 118, 119, 122, 124, 125, 127, 130, 132, 135, 138, 140, 143, 145, 146, 149, 150, 151, 152, 155, 160, 164, 165, 166, 168, 169, 172, 175, 176, 177, 179, 180, 181, 182, 185, 188, 189, 195, 198, 202, 203, 204, 205, 206, 207, 208, 209, 210, 212, 213, 214, 215, 216, 217, 218, 219, 220, 221, 222, 223, 224, 225, 226, 227, 228 or 229; C.I.Solvent Blue 2, 4, 5, 7, 10, 11, 12, 22, 25, 26, 35, 36, 37, 38, 43, 44, 45, 48, 49, 50, 51, 59, 63, 64, 66, 67, 68, 70, 72, 79, 81, 83, 91, 94, 95, 97, 98, 99, 100, 102, 104, 105, 111, 112, 116, 117, 118, 122, 127, 128, 129, 130, 131, 132, 133 or 134; or C.I.Solvent Black 3, 5, 6, 7, 8, 13, 22, 22: 1, 23, 26, 27, 28, 29, 33, 34, 35, 39, 40, 41, 42, 43, 45, 46, 47, 48, 49 or 50.

Among these, C.I.Solvent Yellow 3, 14, 16, 33 or 56, C.I.Solvent Red 18, 24, 27, 122 or 135, C.I.Solvent Blue 14, 25, 35, 48 or 108, or C.I.Solvent Black 3, 7, 22, 34 or 50 is preferred as it has high fastness.

In view of safety or suitability for the ink ejection head of the ink jet recording apparatus, various solvents are selected for the oil-soluble ink. A plurality of solvents may be mixed as the case requires.

The solvent may, for example, be a petroleum naphtha solvent such as Pegasol manufactured by Mobil Sekiyu K.K., Shell SBR or Shellsol manufactured by Showa Shell Sekiyu K.K.; an aromatic petroleum solvent such as Hisol manufactured by Nippon Oil Co., Ltd., an aliphatic petroleum solvent such as Soltol manufactured by Philips Petroleum Intl. Ltd., Exxsol manufactured by Exxon Chemical Japan, Ltd. Isopar manufactured by Exxon Chemical Japan, Ltd., or IP Solvent manufactured by Idemitsu Petrochemical Co., Ltd.; a naphthene petroleum solvent such as Ink Solvent manufactured by Mitsubishi Oil Co., Ltd; an alkyl derivative such as mono- or di-substituted alkylnaphthalene or biphenyl, an aromatic hydrocarbon solvent such as xylylethane or phenethylcumene; a $C_{1-4}$ alkyl alcohol such as methyl alcohol, ethyl alcohol, n-propyl alcohol, isopropyl alcohol, n-butyl alcohol, sec-butyl alcohol, tert-butyl alcohol or isobutyl alcohol; an amide such as dimethylformamide or dimethylacetamide; a ketone or a ketone alcohol such as acetone or diacetone alcohol; an ether such as tetrahydrofuran or dioxane; a polyalkylene glycol such as polyethylene glycol or polypropylene glycol; an alkylene glycol having 2-6 alkylene groups such as ethylene glycol, propylene glycol, butylene glycol, triethylene glycol, 1,2,6-hexane triol, thiodiglycol, hexylene glycol or diethylene glycol; a lower alkylether of a polyhydric alcohol such as glycerol, ethylene glycol methylether, diethylere glycol methyl (or ethyl) ether or triethylene glycol monomethylether; a phosphoric ester such as tributylphosphate, tri-2-ethylhexyl phosphate, triphenylphosphate or tricresylphosphate; a phthalic acid ester such as dimethylphthalate, diethylphthalate, dibutylphthalate, diheptylphthalate, di-n-octylphthalate, di-2-ethylhexylphthalate, diisononylphthalate, octyldecylphthalate or butylbenzylphthalate; an aliphatic monobasic acid ester such as butyl oleate or glycerol monooleate; an aliphatic dibasic acid ester such as dibutyladipate, di-2-ethylhexyladipate, alkyladipate 610, di-2-ethylhexylazelate, dibutylsebacate or di-2-ethylhexylsebacate; an oxyacid ester such as methylacetylricinolate, butylacetylricinolate, butylphthalylbutylglycolate or tributylacetylcitrate; or a plasticizer such as chlorinated paraffin, chlorinated biphenyl, 2-nitrobiphenyl, dinonylnaphthalene, o- or p-toluenesulfone ethylamide, camphor or methyl abictate.

Further, as proposed in JP-B-6-247034 or JP-3-6-306319, the ink jet recording can be conducted by using an oil based ink for so-called heat fusion type ink jet recording. For the oil based ink for heat fusion type ink jet recording, the following solvents are commonly used.

The solvent may, for example, be a wax such as polyethylene wax, ozokerite, ceresin, candelilla wax, rice wax, jojoba solid wax, bees wax, lanolin, spermaceti, Fischer-Tropsch Wax, carnauba wax, paraffin wax, sazol wax, microcrystalline wax or ester wax; a diol such as 1,8-octanediol, 1,10-decanediol or 1,12-dodecanediol; a fatty acid such as lauric acid, stearic acid or palmitic acid; an aliphatic amide such as lauric acid amide, stearic acid amide, oleic acid amide, erucic acid amide, recinoleic acid amide, 12-hydroxystearic acid amide or a special fatty acid amide; an N-substituted fatty acid amide of the formula RCONHR' or RNHCOR'CONHR; an alkylol amide; a higher alcohol such as cetyl alcohol or stearyl alcohol; am aromatic compound such as an aromatic ester or an aromatic alcohol; a monohydric alcohol fatty acid ester such as methyllaurylate, methylmyristate, methylpalmitate, methylstearate, coconut fatty acid methyl, isopropylmyristate, butylstearate, octadecylstearate or oleyloleate; a polyhydric alcohol fatty acid ester such as glycerol fatty acid ester, sorbitan fatty acid ester, propylene glycol fatty acid ester, ethylene glycol fatty acid ester or polyoxyethylene fatty acid ester; an epoxy resin; a polyamide resin; a polyester resin; a polyacrylic resin; a polyurethane resin; or a polyolefin resin.

With regard to the above-mentioned various oil based inks, in order to improve the storage stability or rub resistance after printed, a polar resin such as a polyacrylic ester, a linseed oil denatured alkyd resin, polystyrene, a rosin resin, a terpenephenol resin or an alkylphenol denatured xylene resin may be added thereto. An additive may also be suitably incorporated therein such as a metal-sealing agent, a surface tension-adjusting agent, a surface active agent, a viscosity-adjusting agent, a defoaming agent, a foam-suppressing agent, a release agent, a blowing agent, a penetrating agent, a fluorescent brightening agent, an ultraviolet absorber, a preservative, a water proofing agent, a rheology modifier or an antioxidant.

EXAMPLES

Now, the present invention will be explained with reference to Examples. However, it should be understood that the present invention is by no means restricted to such specific Examples. Further, in the Examples, "parts" and "%" mean "parts by weight" and "% by weight", respectively, unless otherwise specified.

Each ink jet recording sheet obtained in following Examples and Comparative Examples was evaluated by the following methods.

(1) Yellowing of White Paper

The center of one side of a polypropylene plastic file bag of A4 size containing BHT in an amount of 1.0 wt %, was cut by an area of 5 cm×5 cm. The ink jet recording sheet was put in the file bag so that the surface of the ink-receiving layer of the sheet touched the cut side of the file bag, which was then left at a temperature of 30° C. under a relative humidity of 80% for 4 months. On the ink-receiving layer after being left, the part corresponding to the cut square part on the file bag, underwent yellowing. With regard to the part which underwent yellowing, L*a*b* (CIE 1976) before and after the treatment, was measured by using a colorimeter CR-100 produced by Minolta Camera Co., Ltd. The degree of the yellowing may be represented by the difference between b* before and after the treatment (Δb*), and the smaller the value, the smaller the degree of yellowing.

To confirm that ink jet recording properties did not deteriorate even in the case where an organic titanium compound was incorporated in the ink-receiving layer, image density and ink absorptivity of the ink jet recording sheet of the present invention together were evaluated.

(2) Image Density

Solid printing by magenta was conducted on each ink jet recording sheet by means of an ink jet printer of drop-on-demand system, and the optical density was measured by Macbeth RD919.

(3) Ink Absorptivity

On each ink jet recording sheet, small-gage lines of 1 pixel having a length of 5 cm were printed at two-pixel intervals, by an ink jet printer of drop-on-demand system, to obtain a checker pattern for evaluation. The pattern was visually evaluated based on the following standards. If the ink absorptivity was poor, the edge of the small-gage line would be unclear, and in the extreme case, the ink would run in the space between the lines.

○: The small-gage lines had clear edge, and the checker was clear.

Δ: The edge of the small-gage lines was slightly unclear, and the size of the space between the lines were partially different.

X: The edge of the small-gage lines was significantly unclear, and the ink ran on the space between the lines.

Example 1

To 100 parts of wood pulp comprising 90 parts of LBKP having a freeness of 380 ml csf and 10 parts of NBKP having a freeness of 480 ml csf, 20 parts of a pigment comprising precipitated calcium carbonate light and heavy calcium carbonate with a ratio of 1:1, 0.10 part of commercially available alkylketene dimer, 0.03 part of commercially available cation type acryl amide, 1.0 part of commercially available cationic starch and 0.5 part of aluminum sulfate were added, and the mixture was sheeted by a Fourdrinier paper machine to obtain a neutral base paper having a basis weight of 120 g/m$^2$.

On the neutral base paper, an ink-receiving layer coating fluid having the following blending and a pH of 6.1 was coated by a rod bar, so that the dry coating amount was 7 g/m$^2$, followed by drying, which was then subjected to calender treatment to obtain an ink jet recording sheet of Example 1. The ink jet recording sheet of Example 1 thus obtained was subjected to moisture conditioning at a temperature of 20° C. under a relative humidity of 65% for 3 days, and a surface pH as defined in TAPPI T529 was measured, and found to be 7.0.

Blending of Ink-receiving Layer Coating Fluid

Synthetic amorphous silica (Mizukasil P78D manufactured by Mizusawa Industrial Chemicals, Ltd.)

100 parts

PVA (PAV117 manufactured by Kuraray Co., Ltd., 10% aqueous solution)

300 parts

Organic titanium compound (compound of the formula 5, solution of 10% IPA: water=1:1)

30 parts

Water 350 parts

Formula (5)

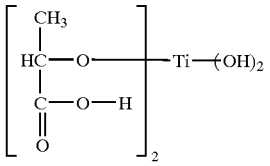

Examples 2 and 3

An ink jet recording sheet of Example 2 or 3 was obtained in the same manner as in Example 1, except that the type of the organic titanium compound in the blending of the ink-receiving layer coating fluid was changed to one of the following formula (6) or (7), each being a solution of 10% IPA: water=1:1, respectively.

Formula (6)

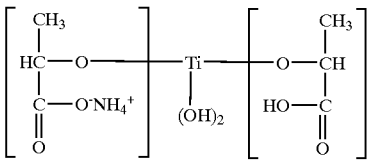

Formula (7)

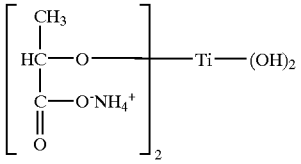

Examples 4 and 5

An ink-receiving layer which did not contain an organic titanium compound, was formed on the neutral base paper in the same manner as in Example 1. Further, on said ink-receiving layer, a 10% IPA solution of organic titanium compound of the following formula (8) or (9) was coated, followed by drying, which was then subjected to calender treatment to obtain an ink jet recording sheet of Example 4 or 5, respectively. Here, the dry coating amount of the organic titanium compound was 0.27 g/m$^2$, which was 5 parts based on 100 parts of the synthetic amorphous silica.

Formula (8)

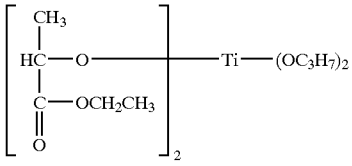

Formula (9)

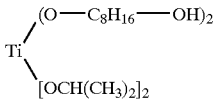

Example 6

On a polyethylene terephthalate transparent film having a thickness of 100 μm and hydrophilic treatment applied thereto, manufactured by ICI Japan Limited, a ink-receiving layer coating fluid having the following blending and a pH of 5.1 was coated by a rod bar so that the dry coating amount was 35 g/m$^2$, followed by drying, to obtain an ink jet recording sheet of Example 6.

Blending of Ink-receiving Layer Coating Fluid

Alumina hydrate (AS-3 manufactured by Catalysts & Chemicals Industries Co., Ltd., 10% aqueous dispersion)

100 parts

PVA (GH23 manufactured by The Nippon Synthetic Chemical Industry Co., Ltd., 10% aqueous solution)

8 parts

Organic titanium compound (compound of the formula 5, solution of 10% IPA: water=1:1)

3 parts

Examples 7 to 10

An ink-receiving layer which did not contain an organic titanium compound was formed on the polyethylene terephthalate transparent film in the same manner as in Example 6. Further, on said ink-receiving layer, a solution of organic titanium compound of the formula 6 or 7 (solution of 10% IPA: water=1:1) or the formula 8 or 9 (10% IPA solution) was coated, followed by drying to obtain an ink jet recording sheet of Examples 7 to 10, respectively. Here, the dry coating amount of the organic titanium compound was 0.65 g/m$^2$, which was 2 parts based on 100 parts of the alumina hydrate.

Examples 11 and 12

An ink jet recording sheet of Example 11 or 12 was obtained in the same manner as in Example 1, except that 0.1% aqueous sulfuric acid solution was suitably added to the ink-receiving layer coating fluid to adjust the pH of the coating fluid to be 5.0 or 4.3, respectively.

Example 13

To 100 parts of wood pulp comprising 90 parts of LBKP having a freeness of 380 ml csf and 10 parts of NBKP having a freeness of 480 ml csf, 20 parts of talc, 3 parts of aluminum sulfate, 0.2 part of commercially available rosin sizing agent and 0.3 part of commercially available cationic starch were added, and the mixture was sheeted by a Fourdrinier paper machine to obtain an acidic base paper having a basis weight of 120 g/m$^2$. An ink jet recording sheet of Example 13 was obtained in the same manner as in Example 1, except that the acidic base paper was used as the support.

Example 14

10% aqueous aluminum sulfate solution was coated on both sides of the neutral base paper used in Example 1 by a rod bar, so that the dry coating amount was 1 g/m$^2$followed by drying, to obtain a pseudo acidic base paper. An ink jet recording sheet of Example 14 was obtained in the same manner as in Example 1, except that the pseudo acidic base paper was used as the support.

Comparative Examples 1 and 2

An ink jet recording sheet of Comparative Example 1 or 2 was obtained in the same manner as in Example 1 or 6, respectively, except that the organic titanium compound was not contained in the blending of the ink-receiving layer coating fluid.

Comparative Example 3

22.4 g of 5% methanol solution having 1.12 g of γ-methacryloxypropyltrimethoxysilane (A-174 manufactured by Nippon Unicar Company Ltd.) was dropwise added to 1,000 g of aqueous dispersion of alumina hydrate (AS-3 manufactured by Catalysis & Chemicals Industries Co., Ltd., 10% aqueous dispersion) under stirring gradually over a period of 20 minutes. Stirring was conducted further for 20 minutes, and then the solvent was distilled off from the obtained mixed liquid by a rotary evaporator under heating at 75° C. The remaining slurry was spread in a shallow tray to conduct drying treatment at a temperature of 110° C. for 3 hours. A powder thus obtained was subjected to grinding treatment to obtain an alumina hydrate having silane coupling agent treatment applied.

An ink jet recording sheet of Comparative Example 3 was obtained in the same manner as in Example 6, except that the alumina hydrate having silane coupling agent treatment applied was used for the ink-receiving layer.

Blending of Ink-receiving Layer Coating Fluid

| | |
|---|---|
| Powder of alumina hydrate having coupling agent treatment applied | 100 parts |
| Polyvinyl acetal (S-LEC KX-1 manufactured by Sekisui Chemical Co., Ltd., mixed solution of 8% IPA and water) | 125 parts |
| Water | 185 parts |
| IPA | 270 parts |

Results of evaluation of the ink jet recording sheets shown in Examples 1 to 14 and Comparative Examples 1 to 3, are shown in Table 1.

TABLE 1

| | Surface pH of recording sheet | Yellowing of white paper Δb* | Image density | Ink absorptivity |
|---|---|---|---|---|
| Example 1 | 7.0 | 3.5 | 1.70 | ○ |
| Example 2 | 6.5 | 1.5 | 1.67 | ○ |
| Example 3 | 6.5 | 1.0 | 1.67 | ○ |
| Example 4 | 7.0 | 3.5 | 1.69 | ○ |
| Example 5 | 7.0 | 4.0 | 1.69 | ○ |
| Example 6 | 6.3 | 4.1 | 1.75 | ○ |
| Example 7 | 6.3 | 1.6 | 1.76 | ○ |
| Example 8 | 6.3 | 1.8 | 1.77 | ○ |
| Example 9 | 6.3 | 3.5 | 1.75 | ○ |
| Example 10 | 6.3 | 3.5 | 1.75 | ○ |
| Example 11 | 6.0 | 2.1 | 1.69 | ○ |
| Example 12 | 5.5 | 1.6 | 1.69 | ○ |
| Example 13 | 5.5 | 2.0 | 1.68 | ○ |
| Example 14 | 6.0 | 2.2 | 1.69 | ○ |
| Comparative Example 1 | 7.0 | 18.0 | 1.69 | ○ |
| Comparative Example 2 | 6.5 | 24.2 | 1.75 | ○ |
| Comparative Example 3 | 6.5 | 18.1 | 1.73 | ○ |

Evaluation

In the ink jet recording sheets of the present 5 invention shown in Examples 1 to 14, as shown in Table 1, yellowing of white paper was prevented. Further, image density and ink absorptivity of such ink jet recording sheets did not deteriorate, thus indicating the ink jet recording sheets satisfying ink jet recording properties and prevention of yellowing of white paper simultaneously.

Particularly in Examples 11 to 14, the surface pH of the ink-receiving layer was at most 6.0, whereby yellowing of white paper was significantly suppressed as compared with Example 1.

On the other hand, in Comparative Examples 1 and 2, as the organic titanium compound of the present invention was not contained in the ink-receiving layer coating fluid, yellowing of white paper was significant. Further, in Comparative Example 3, an alumina hydrate having silane coupling agent treatment preliminary applied was used to form the ink-receiving layer, effects of prevention of yellowing of white paper as in Examples 1 to 14 were not observed. Accordingly, yellowing of white paper can hardly be prevented even if the surface of a pigment or colloidal particles was treated by using a coupling agent except specific organic titanium compound of the present invention.

High quality image can be obtained at low cost by an ink jet recording system, as apparatus such as a printer or a plotter has improved. It is considered that the ink jet recording system will spread widely as a substitute for a silver salt photography, and the stable long-term storage property of the ink jet recording sheet is extremely important. According to the present invention, yellowing of white paper can be prevented while ink jet recording properties such as image density and ink absorptivity can be maintained, and an ink jet recording sheet having excellent storage stability which satisfies marketing needs can be provided.

What is claimed is:

1. An ink jet recording sheet which comprises a support and an ink-receiving layer formed on the at least one side of the support, said ink-receiving layer comprising a pigment, colloidal particles or a mixture thereof, and a binder resin, as the main components, wherein the ink-receiving layer contains an anti-yellowing effective amount of at least one organic titanium compound of the following formula 1 or 2:

Formula 1

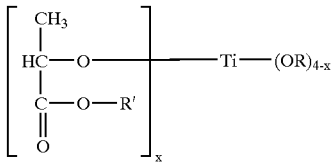

wherein R is hydrogen or $C_mH_{2m+1}$, provided that m is 3 or 4, R' is hydrogen, $NH_4^+$ or $C_nH_{2n+1}$, provided that n is an integer of from 1 to 3, and x is an integer of from 1 to 3, Formula 2

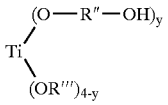

wherein R" is $C_pH_{2p}$, provided that p is an integer of from 5 to 8, R'" is $C_qH_{2q+1}$ provided that q is 3 or 4, and y is an integer of from 1 to 3, wherein said at least one organic titanium compound is present in an amount of from 0.01 to 10 wt.% based on the amount of pigment, colloidal particles or the mixture thereof.

2. The ink jet recording sheet according to claim 1, wherein the ink-reveiving layer has a surface pH of at most 6.0 as defined in TAPPI T 529.

3. The ink jet recording sheet according to claim 2, wherein the support is an acidic base paper made from a slurry containing a natural pulp as the main component.

4. The ink jet recording sheet according to claim 2, wherein the support is a base paper having an aluminium sulfate liquid coated on a neutral paper made from a slurry containing a natural pulp as the main component.

5. The ink jet recording sheet according to claim 1, wherein the support is an acidic base paper made from a slurry containing a natural pulp as the main component.

6. The ink jet recording sheet according to claim 1, wherein the support is a base paper having an aluminium sulfate liquid coated on a neutral paper made from a slurry containing a natural pulp as the main component.

7. A method for producing an ink jet recording sheet as defined in claim 1, which comprises coating a liquid comprising at least one organic titanium compound of the formula 1 or 2, on an ink-receiving layer comprising a pigment, colloidal particles or a mixture thereof, and a binder resin, as the main components, or impregnating said liquid to said ink-receiving layer.

8. The ink jet recording sheet according to claim 1, wherein said at least one organic titanium compound is present in an amount of from 0.1 to 5 wt. % based on the amount of pigment, colloidal particles or the mixture thereof.

9. The ink jet recording sheet according to claim 1, wherein the pigment is a synthetic amorphous silica.

10. The ink jet recording sheet according to claim 9, wherein the colloidal particles are of a pseudo boehmite sol.

11. The ink jet recording sheet according to claim 1, wherein the colloidal particles are of a pseudo boehmite sol.

12. The ink jet recording sheet according to claim 1, wherein said ink-receiving layer is present as a uniform mixture.

13. The ink jet recording sheet according to claim 1, wherein said ink-receiving layer consists essentially of said pigment, colloidal particles or a mixture thereof, said binder resin, and said at least one organic titanium compound.

14. The ink jet recording sheet according to claim 1, wherein said binder resin is free from hydroxyethyl cellulose-containing resins.

15. The ink jet recording sheet according to claim 1, wherein said ink-receiving layer is not crosslinkable to said support.

16. The ink jet recording sheet according to claim 1, wherein components of said ink-receiving layer are not phase separated.

17. The ink jet recording sheet according to claim 1, wherein said ink-receiving layer contains no nonionic fluorocarbon surfactant.

* * * * *